US006491573B1

(12) United States Patent
Barton, II

(10) Patent No.: US 6,491,573 B1
(45) Date of Patent: Dec. 10, 2002

(54) QUICK CHANGE INSERT SYSTEM FOR A FINISHING ARM

(76) Inventor: Kenneth A. Barton, II, 1305 S. Cedar Suite 506, Lansing, MI (US) 48910

( * ) Notice: Subject to any disclaimer, the term of this patent is extended or adjusted under 35 U.S.C. 154(b) by 0 days.

(21) Appl. No.: 09/666,625

(22) Filed: Sep. 20, 2000

(51) Int. Cl.[7] ..... B24B 7/00
(52) U.S. Cl. ..... 451/168; 451/317
(58) Field of Search ..... 451/168, 296, 451/303, 306, 309, 313, 302, 307, 174

(56) References Cited

U.S. PATENT DOCUMENTS 5,210,978 A * 5/1993 Phillips ..... 51/141
5,437,125 A * 8/1995 Barton, II ..... 451/8
5,803,796 A * 9/1998 Barton, II ..... 451/168
6,309,287 B2 * 10/2001 Martin, III et al. ..... 451/303

* cited by examiner

*Primary Examiner*—George Nguyen
*Assistant Examiner*—Dung Van Nguyen
(74) *Attorney, Agent, or Firm*—Mick Nylander

(57) ABSTRACT

A quick change insert system for a microfinishing machine comprising an insert body having a connection side and a finishing side, the connection side including a keyway defined by a central wall and a pair of oppositely disposed sidewalls, the finishing side including at least one finishing support surface; and a finishing arm having an extending key including a central shoulder and a pair of oppositely disposed side walls wherein the insert body keyway and finishing key are correspondingly matingly shaped in a press fit relationship whereby the insert body is retained on the finishing arm during finishing.

6 Claims, 4 Drawing Sheets

Figure - 5
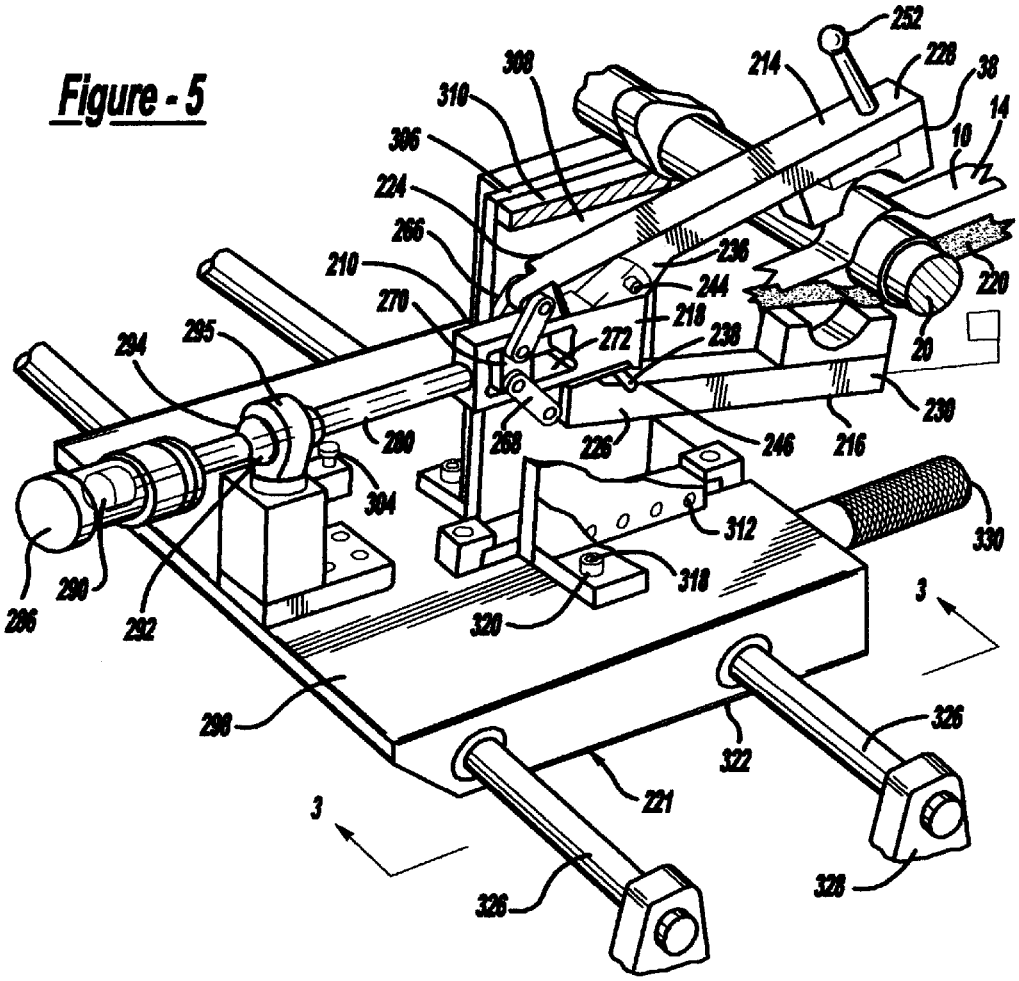
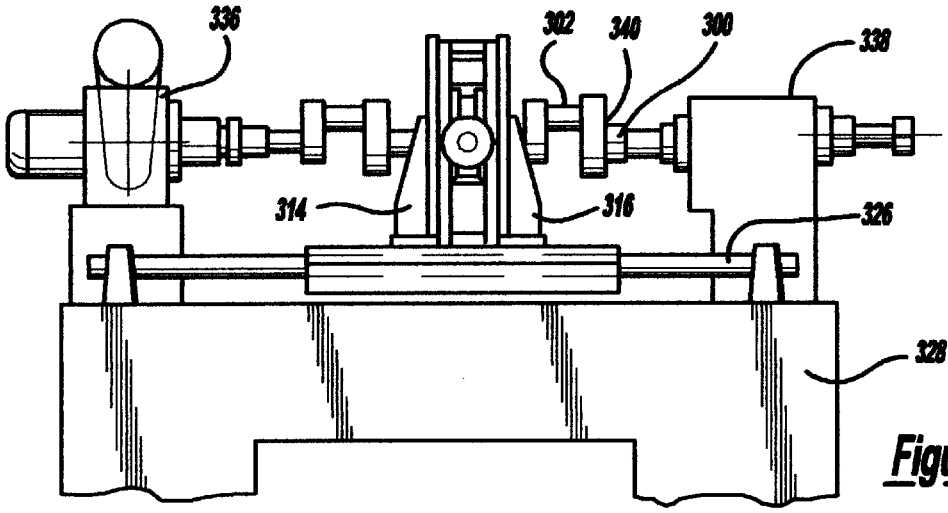
Figure - 6

QUICK CHANGE INSERT SYSTEM FOR A FINISHING ARM

TECHNICAL FIELD

This invention relates generally to a quick change insert for a finishing arm and more particularly to a quick change insert system for a microfinishing arm on a microfinishing machine.

BACKGROUND OF THE INVENTION

"Microfinishing" or "superfinishing", as it is known in the art, is a surface finishing process wherein a grinding means is brought to bear against a workpiece which has been previously rough ground. Microfinishing is a low velocity abrading process which generally follows rough grinding. Because microfinishing incorporates lower cutting speeds than grinding, heat and pressure variants may be minimized to provide improved size and geometry control. Those skilled in the art recognize that surface quality or roughness is measured in roughness average values ($R_a$) wherein $R_a$ is the arithmetical average deviation of minute surface irregularities from hypothetical perfect surfaces. Microfinishing can provide surface quality of approximately 1 to 10 $\mu$in. (0.025 to 0.25 $\mu$m). Bearing surfaces of crankshafts, cam shafts, power transmission shafts in similar machine components that rotate on journal bearing surfaces generally require this surface finish for satisfactory operation.

Conventional mass production microfinishing machines have the ability to finish all the bearing surfaces on a workpiece in one operation. These machines contain a plurality of abrasive tape segments which are aligned with respect to the bearing surfaces. In operation, the workpieces are rotated as the microfinishing machine causes abrasive tape segments to contact and thus finish the bearing surfaces. These large multi-abrading machines are capable of successive steps in one operation including rough grinding, grinding and microfinishing.

As is common in large scale production, failures may occur at one or more of the grinding areas or abrasive tape positions. As a result, workpieces may be produced with one or more bearing surfaces (but less than all bearing surfaces) which are not finished to the required surface quality specifications. In such cases, the grinding machine operator must then remove and scrap the defective workpiece. Because microfinishing is the final stage in surface treatment operations, i.e. after rough grinding and grinding, the scrapping of microfinished parts results in a substantial loss of both material and labor to the machinist.

Microfinishing processes are used in automotive applications in the manufacture, repair and rebuilding of internal combustion (IC) engines. Such engines not only require finely finished bearing surfaces for engine efficiency, but also for increased durability and longevity. In the initial manufacturing stage, crankshaft and camshaft bearing surfaces are microfinished to particular roughness specifications by previously mentioned, conventional mass production microfinishing machines.

In the repair or rebuilding stages, engine components such as crankshafts and cam shafts from faulty engines or older engines, are removed and reground to remove ten to thirty-thousandths of an inch of stock from the existing bearing surfaces. The bearing surfaces of these components are then polished or microfinished by placing the respective workpieces on a lathe and manually bringing a microfinishing material in contact with the rotating bearing surfaces. This microfinishing material is often a section of abrasive material mounted on a support correspondingly shaped to the bearing surface. It is generally recognized in the industry that these manual finishing operations are inadequate for achieving finished surfaces of standard quality.

Automotive repair and rebuilding operations reclaim and refinish workpieces from hundreds of various internal combustion engines with different designs. Programmably controlling a finishing machine to accept each individual workpiece that requires microfinishing from different internal combustion engines is uneconomical and inefficient.

SUMMARY OF THE INVENTION

The quick change insert system of the present invention has been developed to meet the need for a quick change in finishing inserts to decrease maintenance and repair down of microfinishing machines. and well as add greater flexibility and speed in insert type changes.

Accordingly, it is an object of the present invention to provide a quick change insert system for a finishing arm which allows insert change without the use of tools.

Another object of the present invention is to provide a provide a quick change insert system for a finishing arm which allows insert change using a press fit connection system.

A further object of the present invention is to provide quick change insert system for a finishing arm using different hardness qualities of polymers and metals to allow for a press fit connection that is manually operated.

It is a still further object of the present invention to provide a provide a quick change insert system for a finishing arm which uses various correspondly mated key and keyway shapes to allow for the press fit connection It is yet another object of the present invention to provide a provide a quick change insert system for a finishing arm which uses various correspondly mated key and keyway shapes to allow for the press fit connection without the use external fasteners.

A more specific object of the present invention is to provide a quick change insert system for a microfinishing machine comprising an insert body having a connection side and a finishing side, the connection side including a keyway defined by a central wall and a pair of oppositely disposed sidewalls, the finishing side including at least one finishing support surface; and a finishing arm having an extending key including a central shoulder and a pair of oppositely disposed side walls wherein the insert body keyway and finishing key are correspondingly matingly shaped in a press fit relationship whereby the insert body is retained on the finishing arm during finishing.

Another more specific object of the present invention is to provide A microfinishing machine comprising a support table having a means for rotating a workpiece about an axis and a slide rail adjacent the axis, a base including a bore for slidably receiving the slide rail and movable with respect to the workpiece, a body affixed to the base defining a track adapted to be positioned adjacent the workpiece and having a pair of pivot pins spaced from the track, a slide movable on the track, a first arm and a second arm pivotable on the pivot pins, the arms having a first end adapted to receive a quick change insert system for finishing the workpiece and a second end, link means connecting the slide to the second end of the arms for moving the arms about the pivot pins to extend the arms from a treatment enabling position adjacent the workpiece to a treatment position wherein the surface grinding means engages the workpiece, actuating means for movably engaging the slide and the arms, the actuating means operative to move the arms between the treatment enabling position and the treatment position, and a sleeve affixed to the body for receiving and guiding the actuating means, and a support means affixable to the base for pivotally supporting the body with respect to the workpiece whereby the quick change insert includes a an insert body having a connection side and a finishing side, the connection side including a keyway defined by a central wall and a pair of oppositely disposed sidewalls, the finishing side including at least one finishing support surface, and a finishing arm having an extending key including a central shoulder and a pair of oppositely disposed side walls wherein the insert body keyway and finishing key are correspondingly matingly shaped in a press fit relationship whereby the insert body is retained on the finishing arm during finishing.

The above objects and other objects, features and advantages of the present invention are readily apparent from the following detailed description of the best mode for carrying out the invention to be taken in connection with the accompanying drawings.

BRIEF DESCRIPTION OF THE DRAWINGS

FIG. 5 is a perspective partial view of a microfinishing machine using the quick change insert of the present invention;

FIG. 6 is a side view of a microfinishing machine using the quick change insert of the present invention.

DETAILED DESCRIPTION OF THE INVENTION

Figure 1:
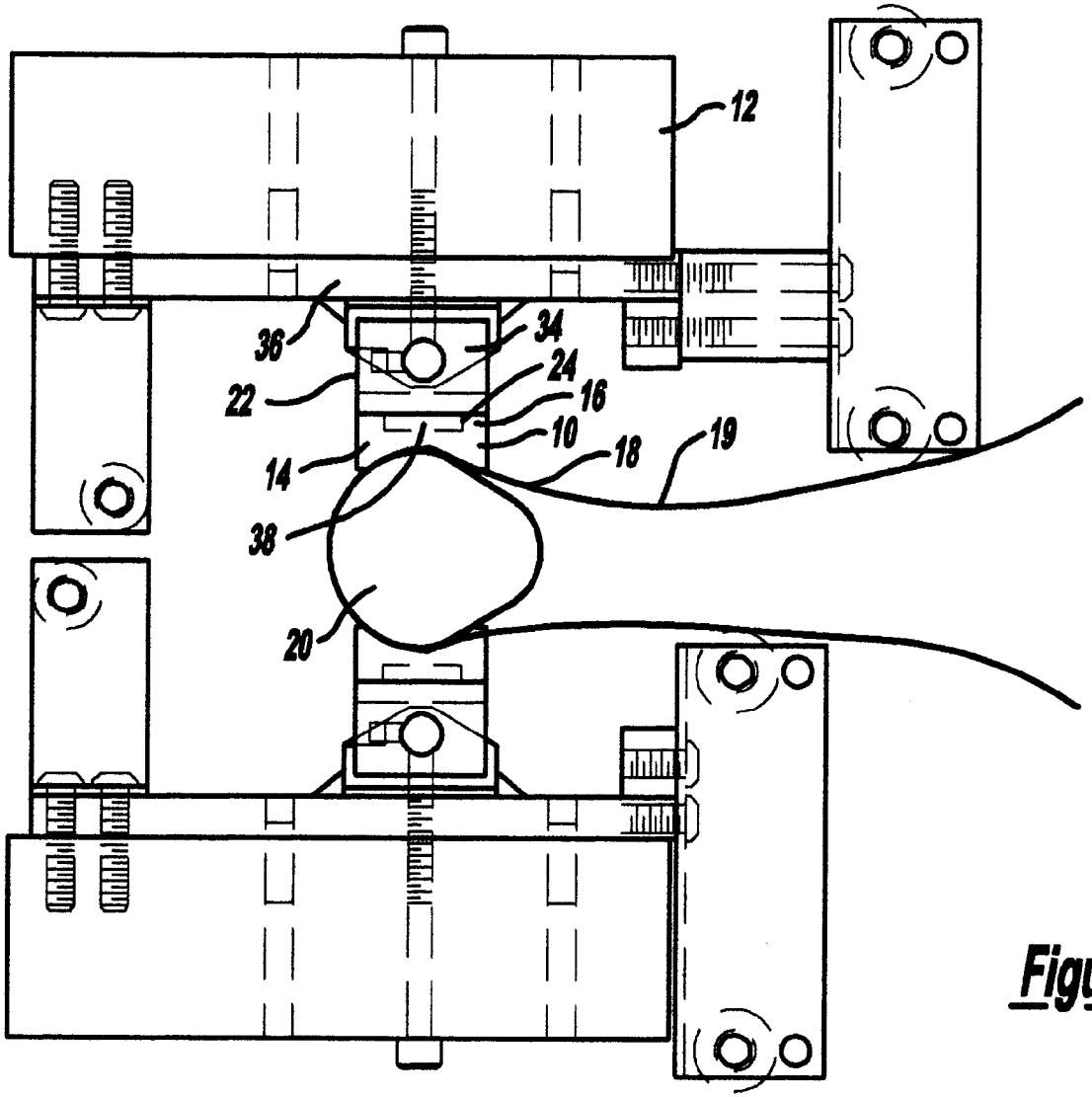
FIG. 1 is a side view of the quick change insert and finishing arm of the present invention.
Figure 2:
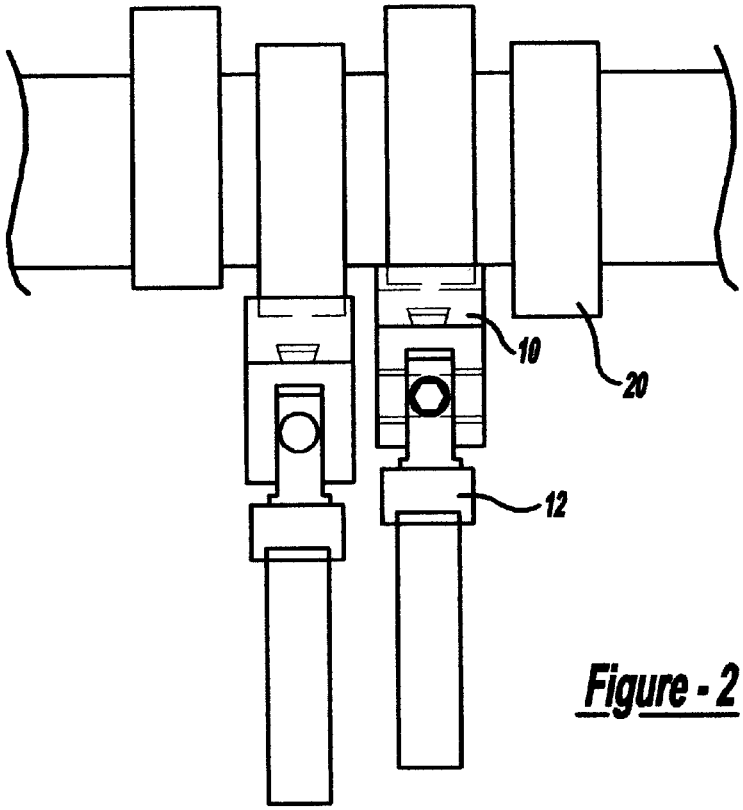
FIG. 2 is a fragmentary top view of the quick change insert of the present invention, including a workpiece.

Referring now to FIG. 1, there is shown a quick change insert 10 and finishing arm 12 of the present invention. Quick change insert 10 has an insert body 14 including a connection side 16 and a finishing side 18. As shown in FIG. 1, the quick change insert is connected to the fishing arm via a press fit connection which is a self contained means for connecting the insert body 14 to the finishing arm 12. The finishing side 18 defines a polishing support surface 32. Adjacent the support surface, there is shown a microfinishing tape 19, which is described below. Workpiece 20 is shown as a camshaft, but may be any workpiece which requires a finished surface.

In the preferred embodiment, the self contained quick change means for connecting the insert body 14 to the finishing arm 12 is integral with the insert body 14. Further, in the preferred embodiment, the quick change insert body 14 is made of a polymer and more specifically a poly urethane.

Figure 3:
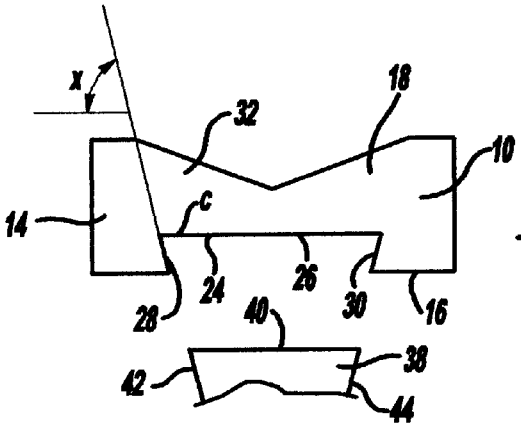
FIG. 3 is a side view of the quick change insert of the present invention.

The quick change insert 10, in conjunction with the finishing arm 12 comprise a quick change insert system 22. As shown in FIG. 3, the quick change insert system 22 uses insert body 14 with connection side 16 and finishing side 18. Connection side 16 includes a keyway 24 defined by a central wall 26 and a pair of oppositely disposed sidewalls 28 and 30. Finishing side 18 includes at least one finishing support surface 32.

Finishing arm 12 has a connection section 34 which is, for example, bolted onto to the finishing arm body 36. The connection section 34 includes an extending key 38 including a central shoulder 40 and a pair of oppositely disposed side walls 42 and 44. The insert body keyway 24 and extending key 38 are correspondingly matingly shaped in a press fit relationship such that insert body 10 is sufficiently retained on the finishing arm 12 during the finishing operation.

In the present invention, the quick change insert system has the pair of oppositely disposed sidewalls 28 and 30 of the insert body 14 defining an angle X to said central wall C in a range from 45 to 80 degrees and preferably in a range from 50 to 65 degrees. In the preferred embodiment, the angle X is in a range from 58 to 62 degrees and ideally in a range from 59 to 61. The present invention has developed and utilizes the advantages of making the insert body 14 of a polymer and the key 38 of a metal. This provides an excellent connection method in that the metal does not give or deform and forces the polyurethane inset body to mold or snap onto the key 38 in the above described press fit relationship. This press fit relationship can be accomplished manually. The insert body is made of a urethane having a hardness in a range from 65 to 95 durometer.

Figure 4:
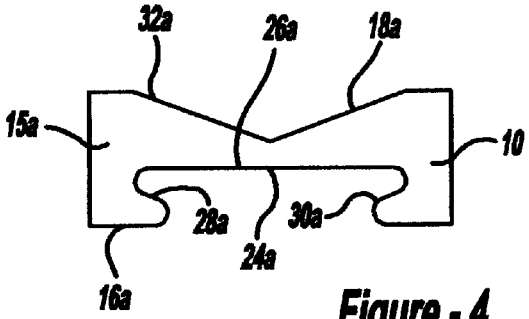
FIG. 4 is a side view of am alternative quick change insert of the present invention.

FIG. 4 discloses an alternative embodiment of the present invention where the sidewalls 28*a* and 30*a* have an annular shape. The embodiment of FIG. 4 has uses the same quick change insert system 22 with an insert body 14*a* with connection side 16*a* and finishing side 18*a*. Connection side 16*a* includes a keyway 24*a* defined by a central wall 26*a* and the pair of oppositely disposed sidewalls 28*a* and 30*a*. Finishing side 18*a* includes at least one finishing support surface 32*a*. The present invention contemplates various cooperating shapes between the insert body and the connection section 34 of the finishing arm 12.

Figure 3A:
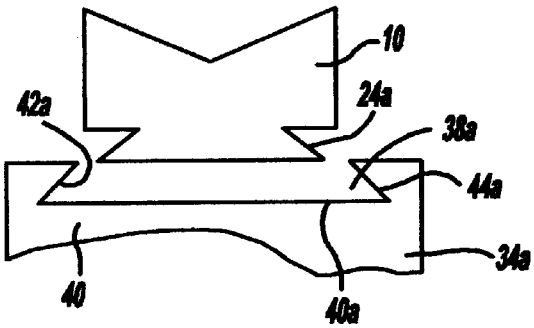
FIG. 3*a* is a side view of an alternative embodiment of the quick change insert of the present invention.

In addition, as shown in FIG. 3*a*, the key and keyway system of the present invention are reversed. The connection section 34*a* includes a keyway 38*a* including a central shoulder 40*a* and a pair of oppositely disposed side walls 42*a* and 44*a*. The insert body has a key 24*a* which, as described above, with the keyway 38*a* correspondingly mates in a press fit relationship such that insert body 10 is sufficiently retained on the finishing arm 12 during the finishing operation.

Figure 7:
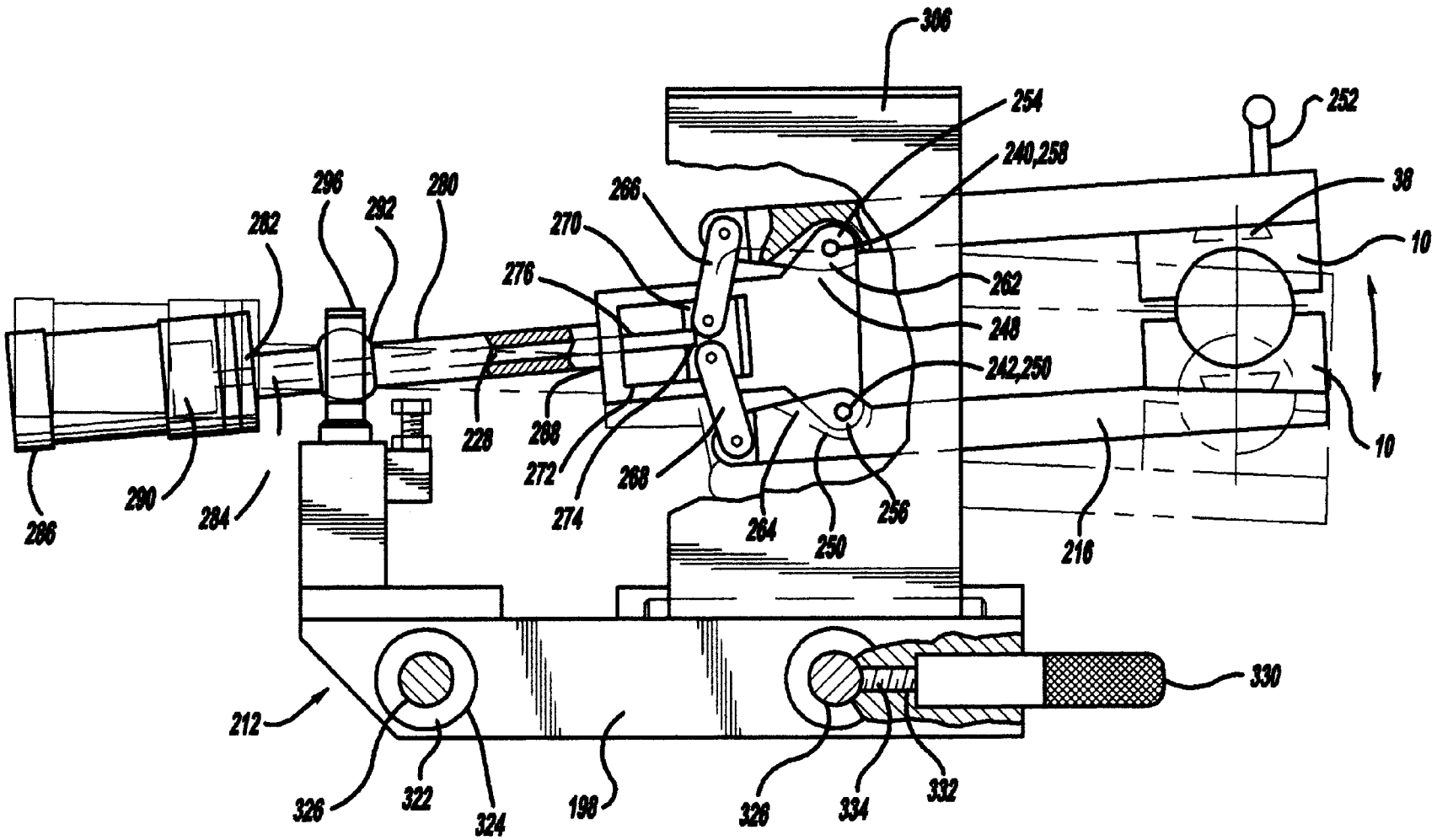
FIG. 7 is a side view of a finishing arm using the quick change insert of the present invention.

Referring now to FIGS. 5–7, there is shown a microfinishing machine 200 which has includes the quick change insert system of the present invention. With reference to FIG. 5, a surface finishing tool is shown generally designated by reference numeral 210. Finishing tool 210 is incorporated in the finishing assembly designated by reference numeral 212. Finishing tool 210 is shown having top and bottom finishing arms 214 and 216 which are both pivotally connected to the finishing tool body 218. The finishing arms 214 and 216 are shown in FIG. 5 in a treatment enabling position located above the bearing surface 220 of an cam shaft 20.

Finishing arms 214 and 216 have first ends 224 and 226 adapted to be pivotably connected to body 218 and second ends 228 and 230 which are constructed to accept various families of grinding means depending on the workpiece and the extent of surface finishing required. FIG. 5 shows an abrasive-coated tape grinding system using the quick change insert system—as described above and abrasive coated abrasive tape 19. Common abrasive tape feed and take-up mechanisms are not shown. Other grinding materials include honing stones using diamond, Carborundum, garnet, cubic boron nitride and other like substances are contemplated with the quick change insert of the present invention and would be introduced between the surface 32 and the workpiece 20.

Referring now to FIGS. 5 and 7, there is shown the quick change insert 10 and the abrasive coated tape 19 adapted to receive the bearing surfaces of a workpiece such as cam shaft 20. Abrasive-coated tape 19 is shown insert 10 to further illustrate the relative positions of the insert body 14, abrasive-coated tape 19 and camshaft 20 during operation of the finishing assembly. Disposed between first ends 224 and 226 and second ends 228 and 230 of top and bottom finishing arms 214 and 216 are identical pairs of connecting members 236 and 238 which extend from respective arms 214 and 216. Connecting members 236 and 238 have throughbores 240 and 242, respectively, which accept pivot pins 244 and 246, respectively.

Finishing arms 214 and 216 have hollowed recesses 248 and 250 disposed between the pairs of connecting members 236 and 238. Upper finishing arm 214 has a handle 252 for bringing upper finishing arm 214 and lower finishing arm 216 together.

Still referring to FIGS. 5–7, finishing tool body 218 is shown having a pair of extending sections 254 and 256 which have respective throughbores 258 and 260 disposed thereon. The connecting members of the finishing arms are adapted to cooperate with the extending sections of the tool body. Throughbores 240 and 242 are of the same diameter as the throughbores 258 and 260 of the finishing arms to allow pivot pins 244 and 246 to be located inside the throughbores and the finishing arm bores.

The finishing arms 214 and 216 are thus pivotably connected to the finishing tool body 218 by placing the connecting members 236 and 238 of finishing arms within the extending sections 254 and 256. Extending sections 254 and 256 have recesses 262 and 264 for receiving the connecting members of the finishing arms 214 and 216. Pivot pins 244 and 246 are press fit inside the throughbores and work as pivoting members for the finishing arms. The surface finishing tool 210 of the present invention is designed to operate with two finishing arms connected to the finishing tool body but it is contemplated that microfinishing may also be accomplished with just one finishing arm.

Referring to FIGS. 5 and 7, the second ends 228 and 230 of the finishing arms 214 and 216 are pivotally connected to two pairs of metal links 266 and 268. The pairs of metal links 266 and 268 are identical and are disposed on opposite sides of the second ends 228 and 230 of the finishing arms. The pairs of metal links 266 and 268 are connected at their other end to slide block 270. Slide block 270 is disposed within hollow track 272 defined within finishing tool body 218.

Hollow track 272 is configured to allow sliding engagement between slide block 270 and track 272. Slide block 270 has a threaded hole 274 for receiving and connecting to tie rod 276. Tie rod 276 extends within hollow chamber 278 of sleeve 280 which is attached at one end 282 to track 272.

The actuating end 284 of tie rod 276 is positioned in a fluid motor such as either a regulated hydraulic or regulated pneumatic cylinder, generally indicated as 286 which is attached to the other end 288 of the sleeve 280. This regulated cylinder 286 is operated by a manual control, not shown, to extend the actuating piston 290 of the regulated cylinder 286 to which the tie rod end 284 is connected. As the actuating piston 290 is reciprocated according to the manual operation of the regulated cylinder, the tie rod is reciprocated moving the slide block within track 272. Tie rod 276 and regulated cylinder 286 act in conjunction with slide block 270 as an actuating means for moving the arms to embrace the surface on the workpiece to be finished.

Referring to FIGS. 5 and 7, as slide block 270 moves laterally, it forces the pairs of metal links 2661 and 268 to move to a vertical position (FIG. 7) and thus force finishing arms 214 and 216 to pivot around pivot pins 244 and 246. This brings first ends 2241 and 226 having quick change inserts and the abrasive coated tape 19 to bear upon the workpiece 20.

Different regulated cylinders with different bores and different stroke lengths produce different finishing pressures on the machine component. The pneumatic regulated cylinder 286 shown in FIGS. 5 and 7 has a one-and-one-half inch bore with a two inch stroke length. Using this size cylinder in cooperation with the predetermined pivot position of each finishing arm and the links, the finishing pressure at the grinding means position using approximately 60 psi of line pressure is approximately 200–300 pounds per square inch.

Compressive contact between the grinding means contained on the finishing arms 214 and 216 and the workpiece surface as the workpiece is being rotated about its longitudinal axis creates the microfinishing action that finishes the surface of the workpiece. FIG. 7 shows a finishing assembly of the present invention with one surface finishing tool 210 affixed. Surface finishing tool 210 is pivotally supported upon finishing assembly 212 by a spherical bearing 292 having an aperture 294 adapted to slidably receive sleeve 280. Spherical bearing 292 is journaled within housing 296 which is connected to base 298 of finishing assembly 212.

Still referring to FIG. 7, sleeve 280 is journaled within aperture 294 of spherical bearing 292. Spherical bearing 292 and housing 296 act as a universal support means for pivotably supporting the surface finishing tool 210 and allows for movement of the finishing tool in any direction. Specifically, the use off spherical bearing 292 and housing 296 allow for vertical, pivotal movement of surface finishing tool 210. This vertical movement is important when microfinishing crank shaft pin surfaces. As shown in FIG. 6, a different workpiece, such as a crank shaft 300 includes a plurality of cylindrical pin bearing surfaces 302 which must be correctly microfinished for correct operation. Adjustable positive stop 304, shown in FIG. 5, is located directly below sleeve 280 to prevent the finishing tool assembly from traveling too far down during the finishing process.

For adequate microfinishing of pin bearing surfaces the entire finishing tool 210 must be movable with respect to the throw of the crank shaft pin bearings. This flexibility is necessary because the blearing surfaces of the pin bearings are positioned eccentrically with respect to the center of rotation of the crankshaft. As shown in FIG. 7, the finishing tool 210 can pivot vertically corresponding to the orbit of most crank shafts. The pivotal connection between the spherical bearing 292 and the sleeve 280 allows for surface finishing tool 210 to orbit with conventional pin bearing surfaces located on most crank shafts.

As shown in FIGS. 5 and 7, a pair of stabilizing plates 306 are located directly adjacent the surface finishing tool 210.

Stabilizing plates 306 stabilize the surface finishing tool 210 against lateral movement during the finishing operation. Stabilizing plates 306 are positioned adjacent the surface finishing tool 210 with a minimum running clearance between surface finishing tool 210 and the inner walls 208 of the stabilizing plates. This minimum running clearance is achieved by locating the stabilizing plates adjacent the surface finishing tool to a point where sliding contact is made between the surface finishing tool and the stabilizing plates. Spacers 310 are disposed between stabilizing plates 306 to allow for stabilizing pressure to be uniformly applied along the stabilizing plates. The stabilizing plates 306 are affixable to spacers 310 by fastening screws 312.

FIG. 6 shows an alternative embodiment of the present invention with adjustable clamping fixtures 314 and 316 located directly adjacent the stabilizing plates. These clamping fixtures may be utilized to provide additional lateral support during the microfinishing process. Screw fasteners 318 are disposed within adjustment slots 320 as shown in FIG. 5, and are used to lock the clamping fixtures not fully shown in FIG. 5 in place.

Base 298 incorporates ball bushings or bearings 322 positioned within slide bores 324 within the base 298. These bearings allow the entire finishing assembly 212 to slide along rails 326 contained on finishing support table 328 as shown in FIG. 6.

A handle 330 is affixed to base 198 to aid in sliding the finishing assembly 212 along rails 326. The mobility of finishing assembly 212 is integral to the operation of the finishing assembly. When only one surface finishing tool is being utilized on the finishing assembly 212, successive bearing surfaces can be microfinished on one workpiece by simply indexing the finishing assembly along the axis of the workpiece and finishing a new surface each time. Finishing assembly 12 can be adapted to be affixed to any lathe type rotational grinding machine which is capable of affording lateral movement of the base.

In addition, handle 330 includes a threaded portion 332 that extends into tapped bore 334 which extends into contact with slide rail 326. This handle 330 may be used as a locking means for securing finishing assembly 212 in one location along slide rails 326. Handle 330 can be rotated to a position wherein threaded portion 332 contacts slide rail 326 and acts as a set screw in securing the finishing assembly in one location. This locking means is particularly useful for microfinishing a series of machine components wherein a particular bearing surface along the length of a machine component is out of specification in a number of machine components.

Handle 330 is also utilized when an operator wishes to induce an oscillating lateral movement in the finishing assembly. This lateral oscillating movement is used by the operator to control the resulting surface tool pattern that is created on the bearing surface being finished by the minute irregularities in the grinding means being used. A handle 330 is also used to move the finishing tool assembly laterally along the workpiece when the surface to be finished has a greater width than the grinding means.

The surface finishing machine of the present invention as shown in FIG. 6, includes a head stock 336 and a tail stock 338 which together cooperate to rotate a machine component or workpiece such as a crankshaft about its longitudinal center axis. To microfinish the crank shaft 300 shown in FIG. 6, the regulated cylinder must be operated so as to retract (FIG. 5) the actuating piston 290 which in turn retracts the tie rod 276 within the hollow chamber 278. As the tie rod 276 retracts, slide block 270 moves laterally towards the regulated cylinder which in turn moves metal links 266 and 268 such that finishing arms 214 and 216 separate. Crank shaft 300 is next placed within head stock 336 and tail stock 338.

Regulated cylinder 286 is next activated to move actuating piston 290 out and toward finishing tool body 218. Actuating piston 290 moves laterally and thus moves tie rod 276 and slide block 270. As slide block 270 moves toward crank shaft 300, finishing arm 214 and 216 encircle or embrace the bearing surface of crank shaft 300. The operator of the machine regulates the pressure of cylinder 286 until the requisite amount of pressure is supplied upon abrasive-coated tape 19 contained on finishing arms 214 and 216.

This amount will vary according to different finishing surface diameters and widths of the bearing on the machine component. The speed that the workpiece is being rotated by the head stock and the duration the grinding means contacts the bearing surface also effects the roughness average values achieved on the bearing surface. Using a common abrasive tape grinding means with a roughness rating of 20 $\mu$m, and rotating the workpiece at 100 rpms, a pressure of approximately 100 psi for 15 seconds induces a roughness value of approximately 15 $R_a$.

The surface finishing assembly according to the present invention, as stated earlier, can be used in large scale manufacturing processes in the industry to recover workpieces scrapped at the microfinishing stage. This is accomplished by removing the scrapped workpiece from the microfinishing machine after an out of specification or incorrect bearing surface has been identified and installing it within the surface finishing assembly of the present invention.

The machine operator may then microfinish the particular bearing surface to the required specification, and thus reclaim the workpiece from scrap. As is known in the industry, machine components that are at the microfinishing stage represent the highest economic investment in the manufacturing process and it is thus very desirable to reclaim the workpiece at these late stages.

Manual microfinishing procedures of the prior art are inherently subjective to the operator performing the procedure and thus may be inadequate in achieving standard surface finishes required for modern internal combustion engine components. The surface finishing assembly of the present invention is able to achieve standard surface finishes on a consistent basis, with consistent quality, and are able to achieve microfinishing levels suitable for modern internal combustion engine components.

Automotive repair and rebuild operations, as stated previously, often remove machine components from engines and microfinish bearing surfaces contained on those components. The surface finishing assembly of the present invention can be utilized to microfinish these various components with a degree of standardization that is higher than prior art procedures. In addition, the surface finishing assembly is configured to accept machine components from many different internal combustion engines. The surface finishing assembly can thus accept crankshafts and camshafts from single cylinder, to multiple cylinder engines without significant modifications.

It can be seen from the above disclosure, that the surface finishing assembly of the present invention is flexible enough to accommodate many various workpieces and can also surface finish many different surfaces on a particular workpiece. The ability to accept many different machine components and also to finish many different surfaces along the component without having to program automatic computer sequences makes the present invention economically desirable as compared to other large, dedicated microfinishing machines known in the industry.

While the best mode for carrying out the invention has been described in detail, those familiar with the art to which this invention relates will recognize various alternative designs and embodiments for practicing the invention as defined by the following claims.

What is claimed is:

1. A microfinishing machine comprising:

a support table having a means for rotating a workpiece about an axis and a slide rail adjacent said axis;

a base including a bore for slidably receiving said slide rail and movable with respect to said workpiece;

a body affixed to said base defining a track adapted to be positioned adjacent said workpiece and having a pair of pivot pins spaced from the track;

a slide movable on the track;

a quick change insert system comprising an insert body having a connection side and a finishing side, said connection side including a keyway defined by a central wall and a pair of oppositely disposed sidewalls, said finishing side including at least one finishing support surface;

a first finishing arm and a second finishing arm pivotable on said pivot pins, said arms each adapted to receive said quick change insert system for finishing said workpiece, said arms including an extending key including a central shoulder and a pair of oppositely disposed side walls wherein said insert body keyway and extending key are correspondingly matingly shaped in a press fit relationship whereby said insert body is retained on said finishing arms during finishing;

link means connecting the slide to the second end of the arms for moving the arms about said pivot pins to extend the arms from a treatment enabling position adjacent said workpiece to a treatment position wherein said insert body engages said workpiece;

actuating means for movably engaging the slide and the arms, said actuating means operative to move the arms between said treatment a position and said treatment position; and a sleeve affixed to said body for receiving and guiding said actuating means; and a support means affixable to the base for pivotally supporting the body with respect to the workpiece.

2. The quick change insert system of claim 1 wherein at least one of said insert body pair of oppositely disposed sidewalls defines an angle to said central wall in a range from 50 to 65 degrees.

3. The quick change insert system of claim 2 wherein at least one of said insert body pair of oppositely disposed sidewalls defines an angle to said central wall in a range from 58 to 62 degrees.

4. The quick change insert system of claim 1 wherein said insert body is made of a polymer and said key is made of a metal.

5. The quick change insert system of claim 1 wherein said insert body is made of a urethane having a hardness in a range from 65 to 95.

6. The quick change insert system of claim 1 wherein said press fit relationship is such that said insert body and key can be manually connected.

* * * * *

UNITED STATES PATENT AND TRADEMARK OFFICE

CERTIFICATE OF CORRECTION

PATENT NO. : 6,491,573 B1 
DATED : December 10, 2002
INVENTOR(S) : Kenneth A. Barton, II It is certified that error appears in the above-identified patent and that said Letters Patent is hereby corrected as shown below:

Column 10,
Lines 16, 20, 24, 27 and 30, delete "quick change insert system" and insert -- microfinishing machine --.

Signed and Sealed this

Fifth Day of August, 2003

JAMES E. ROGAN
*Director of the United States Patent and Trademark Office*